United States Patent [19]

Katona

[11] 4,041,930

[45] Aug. 16, 1977

[54] WINDOW UNIT FOR OVEN DOORS

[75] Inventor: Joseph W. Katona, Walled Lake, Mich.

[73] Assignee: Mills Products, Inc., Farmington, Mich.

[21] Appl. No.: 635,100

[22] Filed: Nov. 28, 1975

[51] Int. Cl.[2] ..... F24C 15/04

[52] U.S. Cl. ..... 126/198; 126/200

[58] Field of Search ..... 126/198, 200; 52/304, 52/616

[56] References Cited

U.S. PATENT DOCUMENTS

| | | | |
|---|---|---|---|
| 2,394,176 | 2/1946 | Hillebrand | 126/200 |
| 3,500,815 | 3/1970 | De Weese et al. | 126/200 |
| 3,665,915 | 5/1972 | Katona et al. | 126/200 |
| 3,828,763 | 8/1974 | Wilson | 126/200 |

*Primary Examiner*—John J. Camby
*Assistant Examiner*—Larry I. Schwartz
*Attorney, Agent, or Firm*—Whittemore, Hulbert & Belknap

[57] ABSTRACT

Self-contained window units adapted for assembly into an oven door of the type having a vertical air passage for the flow of air by convection through the space between the front and back door panels, the window units having two glass panes, means holding the glass panes in spaced parallel relation and having openings therein defining an air flow passage between the panes aligned with the air passage through the door. Several modifications disclosed show various means of providing for easy removal of one or both of the panes for cleaning.

12 Claims, 19 Drawing Figures

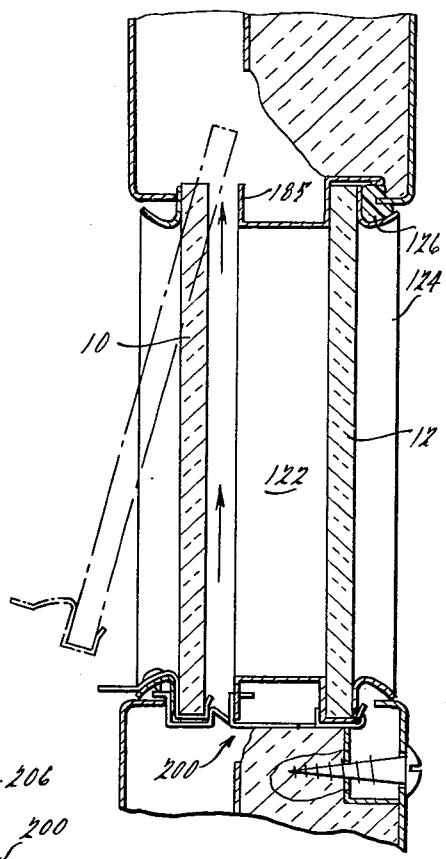
FIG. 14.
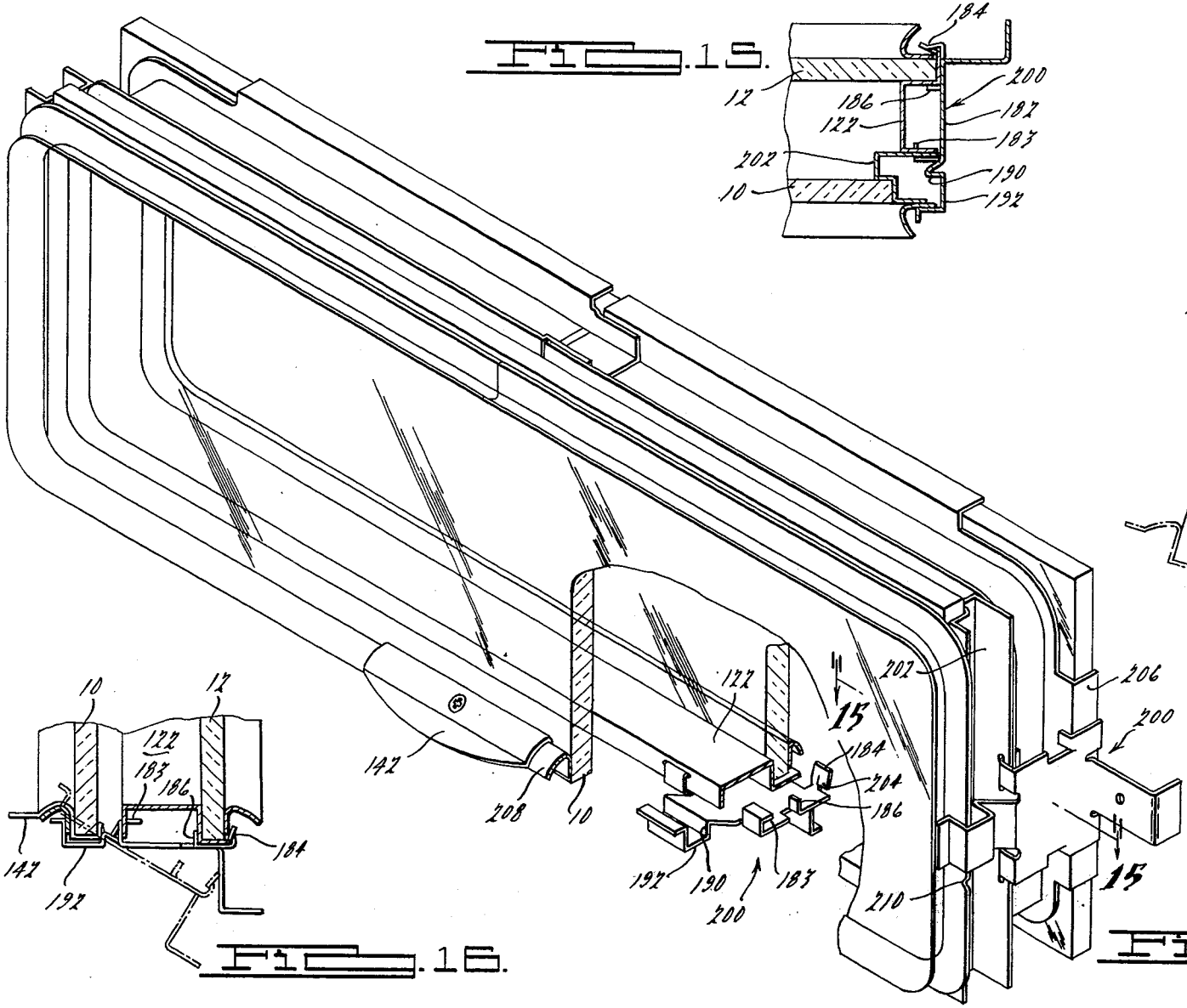
FIG. 13.
FIG. 15.
FIG. 16.

WINDOW UNIT FOR OVEN DOORS

BACKGROUND OF THE INVENTION

Window units for oven doors conventionally have consisted of constructions in which the space between the glass panes is sealed to prevent oven vapors from penetrating that space and subsequently condensing on the glass surfaces. Such constructions result in the outer surface of the outer glass reaching fairly high temperatures. Various attempts have been made to reduce the temperature of the outer glass by providing for the flow of air by convection over the inner surface of the outer glass but such proposals have frequently involved constructions that require the use of three panes of glass or that could not utilize a self-contained window unit adapted for easy installation into the oven doors of the various oven manufacturers. The present invention provides such a self-contained unit having the advantages of cooling the outer glass by an air flow over its inner surface and providing for the easy removal and replacement of the glass for cleaning purposes.

SUMMARY OF THE INVENTION

According to the present invention, the glass panes are held in spaced parallel relation by clamping and spacing elements which do not seal the space between the panes but have openings at the top and bottom of the unit which communicate with the air flow passage in the door. In some disclosed modifications these openings are provided in a spacer interposed between the two glass panes and in other forms of the invention the panes are held in spaced relation by mounting bracket and connector elements at only selected locations around the periphery of the panes, with the space between the panes being otherwise open for the free flow of air therebetween. Since the space between the panes is not sealed, the interior surfaces thereof will become soiled and the construction therefore includes a means for permitting easy removal and replacement of one or both of the panes by the consumer to permit cleaning of these otherwise inaccessible surfaces. The various disclosed contructions readily permit the self-contained window units to be made of different thicknesses and to have any desired mounting means integral therewith to adapt the window unit for assembly into door constructions of different manufacturers.

IN THE DRAWINGS

FIG. 3 is a fragmentary perspective view of a window unit similar to that shown in FIG. 1 but illustrating a modification thereof;

FIG. 8 is a sectional view showing the window unit of FIG. 7 installed in an oven door;

FIG. 13 is a perspective view of a modified form of the invention shown in FIG. 10;

FIG. 14 is a vertical sectional view of the unit shown in FIG. 13;

FIG. 15 is a horizontal sectional view taken on line 15—15 of FIG. 13;

FIG. 16 is a fragmentary sectional view illustrating the manner of assembling the unit shown in FIG. 13;

Figure 1:
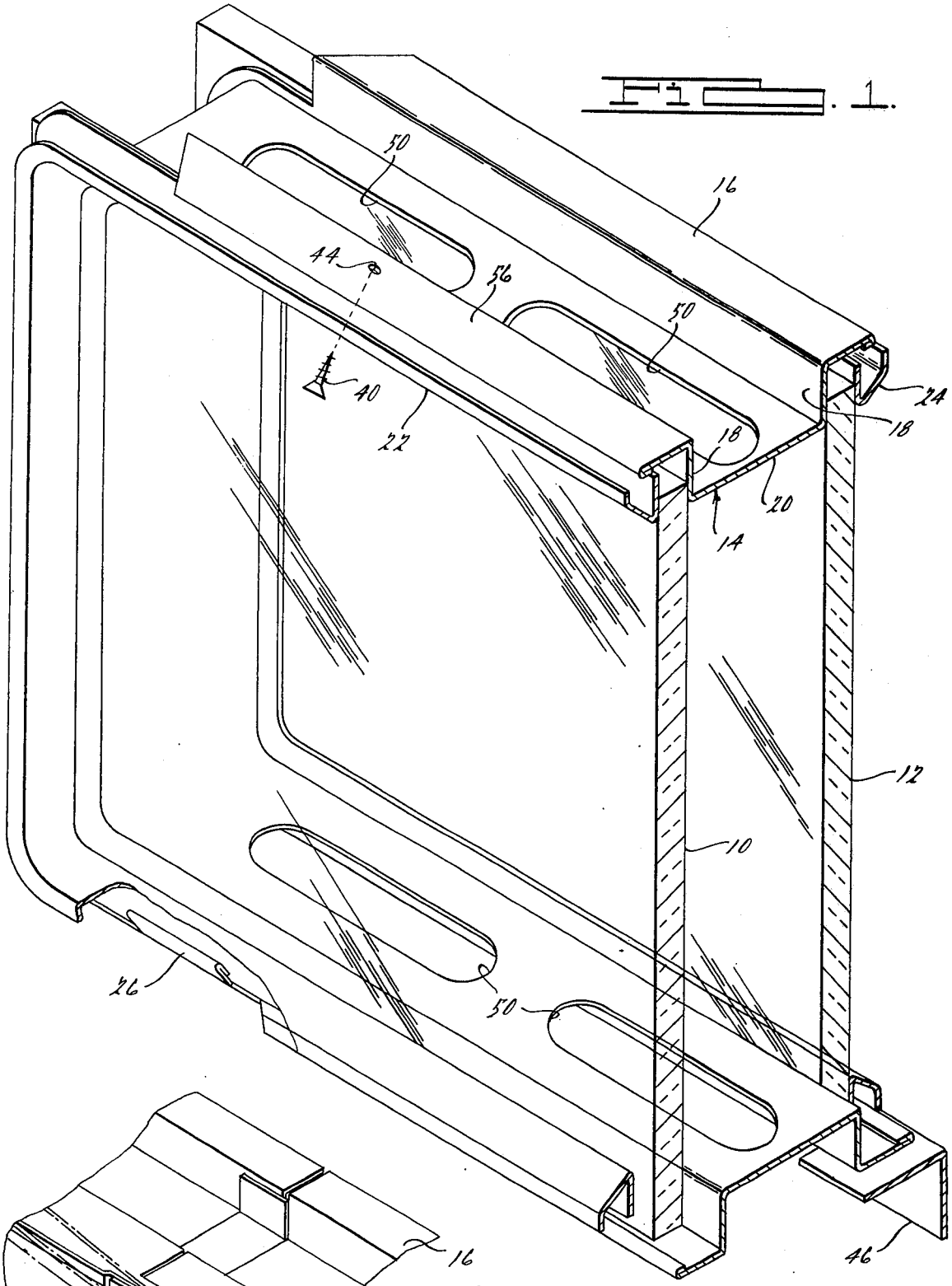
FIG. 1 is a fragmentary perspective view of a window unit according to the present invention.
Figure 2:
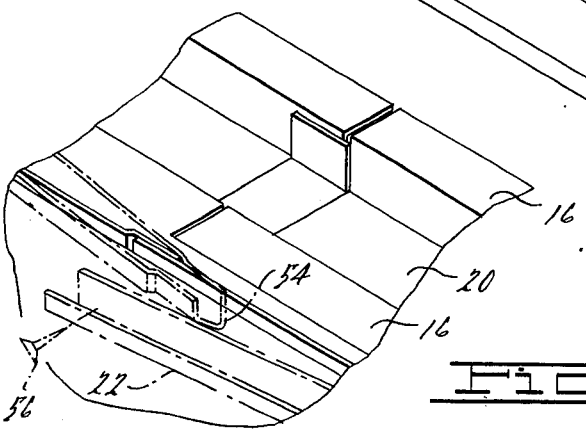
FIG. 2 is a vertical sectional view showing the window unit assembled into an oven door.
Figure 2:
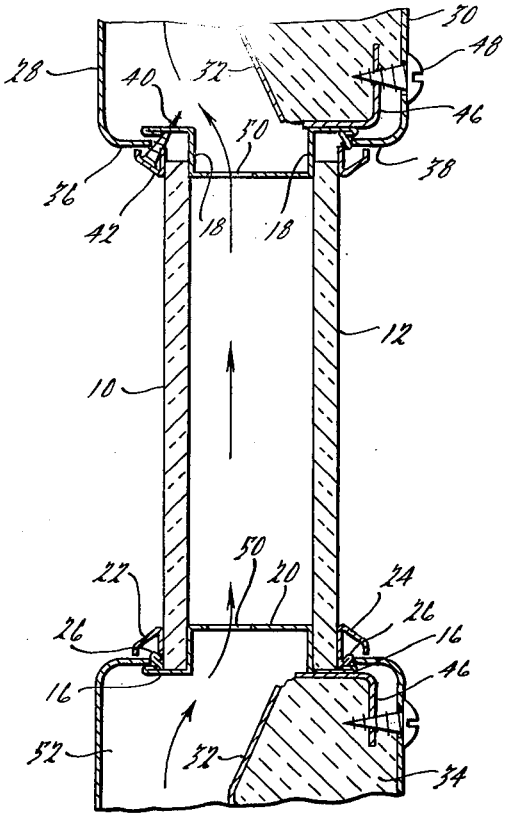

In the form of the invention shown in FIGS. 1 and 2 a pair of glass panes 10 and 12 are maintained in spaced parallel relationship by a spacing and clamping member 14 which extends around the periphery of the panes 10 and 12. The spacing and clamping member 14 is of generally channel-shaped cross section having laterally extending flanges 16. The opposing side walls 18 of the member 14 engage the peripheral portions of the glass panes 10 and 12 and are connected by the web portion 20.

Trim rings 22 and 24 respectively engage and extend around the peripheral portions of the panes 10 and 12. The trim rings 22 and 24 are clamped against the exposed surfaces of the panes 10 and 12 by holding tabs 26 which are inwardly bent portions of the lateral flanges 16 of the member 14. The holding tabs 26 are provided at spaced locations along the bottom edge of the unit at both the inner and outer sides thereof, as shown in FIG. 2. However, along the upper edge of the unit the holding tabs 26 are provided only on one side of the unit which is the oven side of the unit shown in FIG. 2. With this construction the inner glass pane 12 is permanently held in place by holding tabs 26 along its top and bottom edges while the outer pane 10 is retained by the holding tabs only along is bottom edge.

FIG. 2 illustrates the window unit installed in an oven door which includes a front door panel 28, a back door panel 30 and a centrally disposed baffle 32 which is adapted to retain insulating material 34 between the baffle 32 and the back door panel 30. The front and back door panels 28 and 30 have inwardly turned flanges 36 and 38 respectively which define the window opening in the oven door.

The trim ring 22 which engages the outer glass pane 10 is secured along its upper edge to the member 14 by a pair of screws 40 which extend through holes in the wall portion 42 of the trim ring and are threaded into openings 44 in the outer lateral flange 16 of the member 14. The screws 40 do not detract from the appearance of the unit since they are not normally visible. Thus, the unit shown is an entirely self-contained unit adapted for assembly into the oven door. A series of mounting clips 46 may be secured to the inner flange 16 of the member 14 at suitable locations to receive screws 48 extending through the back door panel 30 and threaded into the mounting clips 46 to secure the window unit to the door panel 30. It should be noted that the flanges 36 and 38 on the door panels extend inwardly between the trim rings 22 and 24 and the flanges 16 on the spacing and clamping member 14. This serves to locate the window unit within the door opening during assembly of the window unit into the door.

The wall 20 of the member 14 has a series of elongated slots 50 therein along the top and bottom edges of the unit. These slots 50 provide for the free flow of air upwardly by convection through the space between the panes 10 and 12, thereby cooling the inner surface of the outer pane 10 to reduce the temperature of its outer surface. The openings 50 in the spacer are in communication with the air passage 52 through the door which is defined between the outer door panel 28 and the baffle 32.

In order to provide for cleaning of the unexposed surfaces of the glass panes 10 and 12, it is merely necessary for the user to remove the screws 40 which secure the upper edge of the outer trim ring 22 to the member 14 whereupon the trim ring may be pulled outwardly and upwardly, freeing its lower edge from the holding tabs 26. The glass 10 is then easily lifted free of the holding tabs 26. The trim ring is replaced by inserting the lower edge thereof behind the holding tabs 26 and then replacing the screws 40.

In FIG. 3 there is shown a modified form of the invention illustrated in FIGS. 1 and 2. In the construction of FIGS. 1 and 2 the two ends of the removable trim ring may be welded or otherwise secured together, but in the FIG. 3 construction one end of the outer trim ring has a portion 54 of reduced cross section which is telescoped into the other end of the trim ring. With this arrangement only a single screw 56 is employed to hold the two ends of the trim ring together. The unit illustrated in FIG. 3 is otherwise similar to that shown in FIGS. 1 and 2 except that holding tabs 26 would be employed along the vertical sides of the unit as well as along the bottom edge, and in addition the screw 56 is merely threaded into the telescoped ends of the trim ring and need not be threaded into the corresponding flange 16 of the spacing and clamping member 14. By removal of the single screw 56 the ends of the trim ring are released whereupon the sides thereof may be swung inwardly to release the side edges from their holding tabs and the trim can then be lifted clear at the bottom holding tabs 26.

Figure 4:
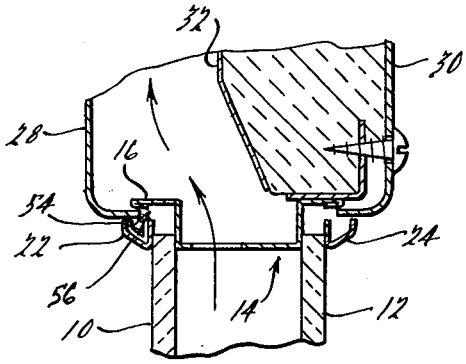
FIG. 4 is a fragmentary vertical sectional view illustrating a further modified form of the invention.

FIG. 4 illustrates the unit of FIG. 3 assembled into an oven door of the kind shown in the prior modification. In this form of the invention either the outer trim ring 22 or the inner trim ring 24, or both, may be removable to permit removal of either or both of the panes 10 and 12 although normally it should be sufficient to allow for removal of only one of the glass panes.

Figure 5:
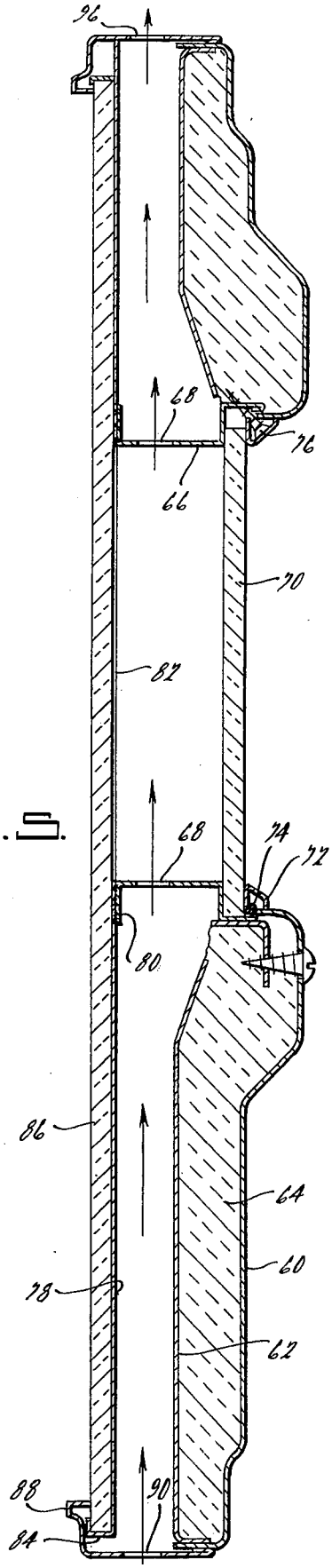
FIG. 5 is a vertical sectional view showing another modification of the invention installed in an oven door.
Figure 2:
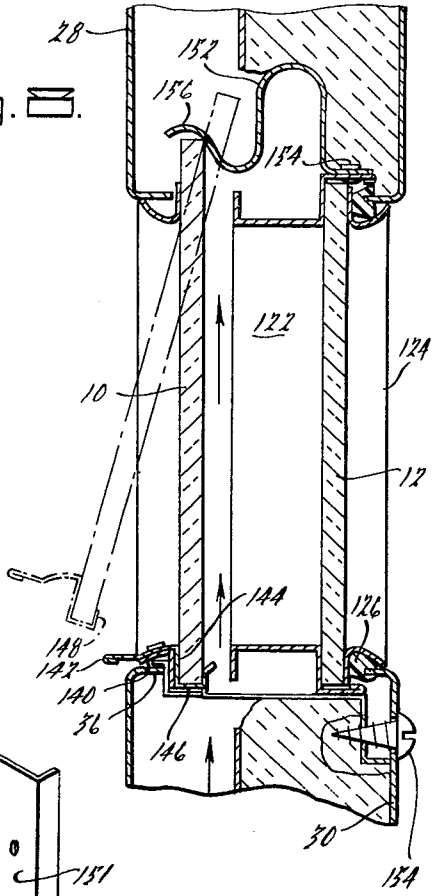

FIG. 5 illustrates a further modification of the invention adapted for use in an oven door of somewhat different construction. In this form of the invention the oven door includes a back panel 60 and baffle 62 having insulation 64 therebetween. The window unit comprises a spacing and clamping member 66 having openings 68 therein which communicate with the air passage through the door. The inner glass pane 70 is clamped against the spacer 66 by a trim ring 72 which is clamped against the pane 70 by holding tabs 74 similar to the holding tabs described in connection with the previous modifications. Along its upper edge the trim ring 72 is held against the upper edge of the glass pane 70 by screws 76 as described in connection with the modification of FIGS. 1 and 2. It is apparent that the rear trim ring 72 could also be of the construction shown in FIGS. 3 and 4.

The window unit further includes a flat sheet of metal 78 which is welded to the outwardly turned flange 80 on the spacing and clamping member 66 and has a window opening 82 therein. The outer periphery of the metal sheet 78 has an outwardly extending channel 84 which is wrapped around the peripheral edges of the outer glass pane 86 which is permanently retained in position against the metal sheet 78. The oven door includes a peripheral frame member 88 which is welded or otherwise secured to the back door panel and extends around and overlaps the peripheral retaining channel 84. The frame member 88 has openings 90 in its top and bottom edges to provide for the upward flow of air by convection through the oven door and the window unit. In oven doors of this type in which the front glass is substantially coextensive in area with the oven door, the front glass may be colored or provided with a pattern in its peripheral portions. The unit shown in FIG. 5 is thus also a self-contained window unit having provisions for the flow of air between the glass panes and also having provisions for removal of the inner glass pane for cleaning.

Figure 6:
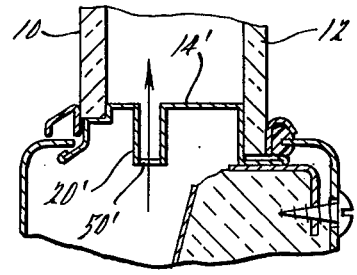
FIG. 6 is a fragmentary vertical sectional view illustrating a further modification of the invention.

In FIG. 6 there is disclosed a modified form of spacer means that may be employed in any of the previously described constructions and in this form of the invention the spacer 14′ is provided with an outwardly extending portion 20′ along its top and bottom edges and the openings 50′ are located in such portions of the spacer. By virtue of this construction the air openings through the window unit are not visible during normal use of the oven.

Figure 7:
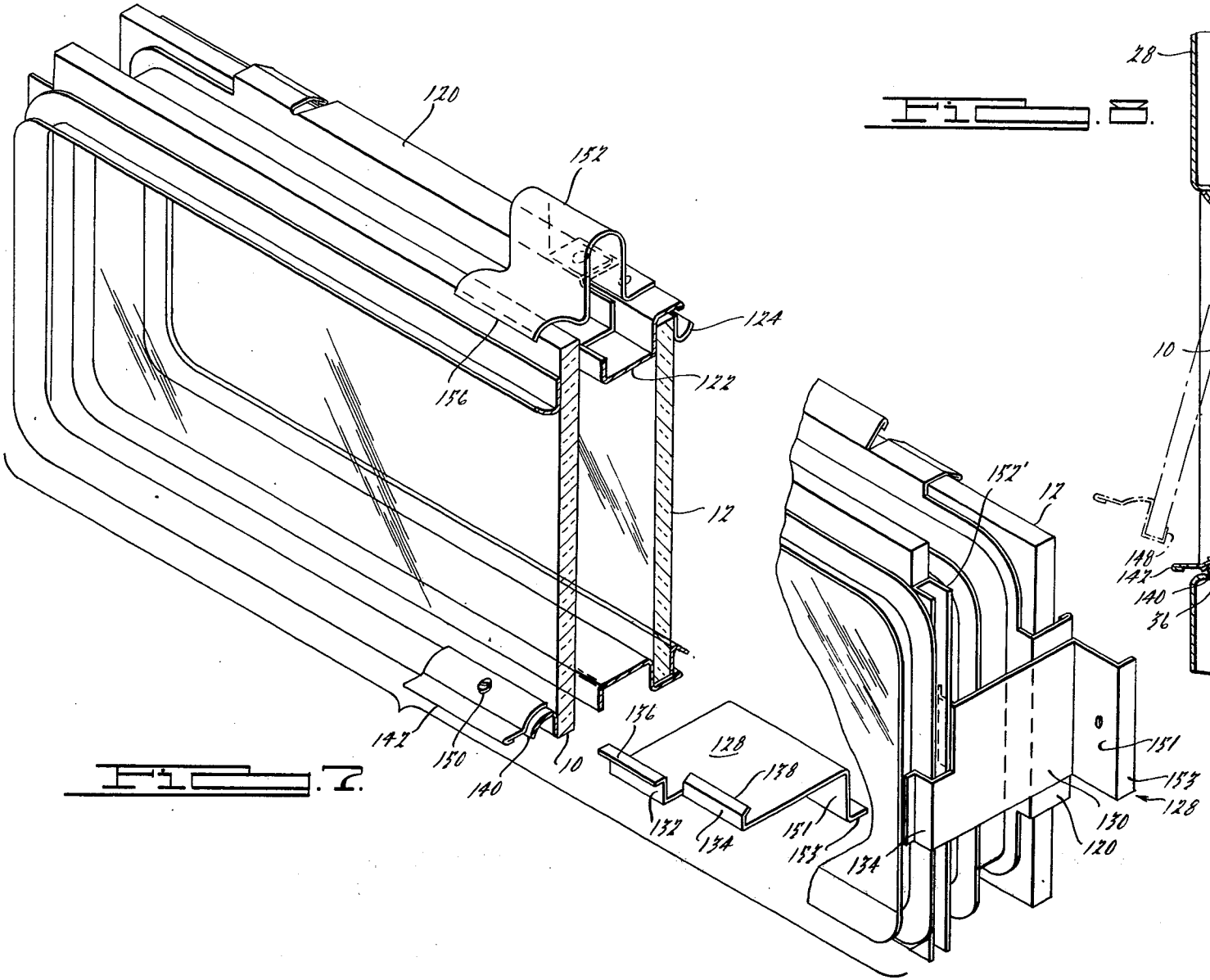
FIG. 7 is a fragmentary perspective view of another form of the invention.

In the form of the invention shown in FIGS. 7 and 8 the glass pane 12 on the oven side of the unit is surrounded by the laterally extending flange 120 of a channel-shaped supporting member 122. A trim ring 124 engages the peripheral surface of the pane 12 and an annular sealing gasket 126 is seated within the outwardly opening channel defined by the trim ring 124. At each of the side edges of the unit a mounting bracket and connector member 128 has a plate portion 130 welded to the flanges 120 which extend across the peripheral side edges of the glass pane 12. There are also two of the mounting bracket and connector elements 128 secured in a similar manner to the flange 120 which extends across the bottom of the unit. At its outer end each of the elements 128 has a pair of flanges 132 and 134 which are disposed in parallel relation but spaced apart a distance slightly greater than the thickness of the outer glass pane 10. The flange 132 has an outwardly bent end 136 which rests on the door flange 36 and supports the weight of the outer glass 10, while the flange 134 has an inwardly bent upper end 138. A trim ring 140 engages the peripheral edges of the outer glass pane 10 and as shown in FIG. 8 seats against the flanges 132 on the connector elements 128.

A lifting tab 142 has one leg 144 seated against the inner leg of the trim ring 140 and also has a channel portion 146 which receives the lower edge of the pane 10. The other leg 148 of the lifting tab 142 engages the inner surface of the pane 10 and the outer surface of the flange 134 on the connector elements 128 at the bottom edge of the unit. The lifting tab 142 may be secured to the trim ring 140 by a screw 150 if desired.

A leaf spring 152 is secured to the flange 120 by a rivet 154 or in any other suitable manner. The outer end 156 of the spring 152 engages the upper edge of the glass pane 10 as shown in FIG. 8 and urges the pane 10 outwardly and downwardly to firmly seat the glass within the supporting channel defined by the flanges 132 and 134 of the connector elements 128. Since the mounting member 122 terminates in spaced relation to the inner surface of the glass pane 10, there is an uninterrupted passage between the glass panes for the flow of air upwardly between the panes as shown in FIG. 8. The construction of the oven door in this embodiment of the invention is essentially the same as described in prior embodiments, with the self-contained window unit being secured to the back door panel 30 by screws 154 threaded into the flange portions 151 of the connector elements 128. This construction has the advantage of providing a minimum of thermal conduction between the oven side of the window unit and the kitchen side and at the same time maximum air flow occurs since only the connector elements 128 and the spring 152 connect the two sides of the unit. The front pane may be removed for cleaning of the unexposed surfaces of the glass merely by removing the screw 150 and lifting upwardly and outwardly on the tab 142 until the glass assumes the position shown in FIG. 8 whereupon it may be lowered to remove the glass. The screw 150 need not be used but provides a safety feature in that it would discourage children from inadvertently removing the front glass from the unit. The front glass 10 has a width slightly less than the spacing of the opposite ends of trim ring 140 to permit removal of the glass.

Figure 9:
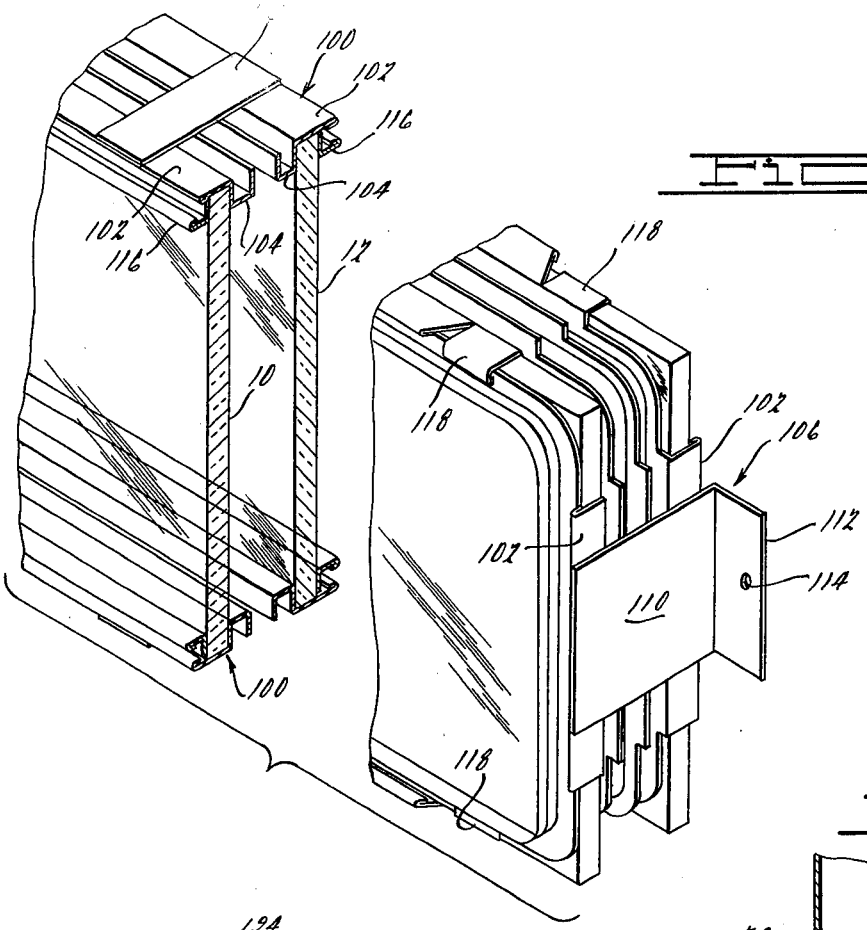
FIG. 9 is a fragmentary perspective view showing another form of the invention.

FIG. 9 shows a modified form of the invention in which each of the glass panes 10 and 12 is provided with a separate clamping member 100 which may be identical in construction. Each of the members 100 has a laterally extending flange portion 102 and an inner channel-shaped portion 104. The peripheral edge of the glass pane is seated against the flange 102 and its inner peripheral surface is seated against the channel formation 104. In the assembled condition of the window unit the channel formations 104 are spaced apart as shown entirely around the periphery of the unit. The two members 100 are secured together only at selected locations around the periphery of the unit. It is contemplated that the two halves of the unit will be held together by a combination mounting bracket and connector member 106 at each of the side edges of the unit and by connector plates 108 at the top and bottom edges of the unit. The combined mounting bracket and connector elements 106 comprise a plate portion 110 which may be welded to the flange portions 102 of the members 100 and a laterally extending flange 112 having an aperture 114 adapted to receive a screw for securing the window unit to the back door panel. Trim rings 116 engage the peripheral surfaces of the glass panes and are clamped against the panes by holding tabs 118 at spaced locations along the top and bottom edges of the unit. This construction has the advantage of permitting a minimum amount of heat transfer by conduction from the oven side of the unit to the kitchen side since thermal conduction can occur only through the connector elements 106 and 108. This construction also maximizes the area of the air flow passage between the panes of glass.

Referring again to FIG. 7, at each side of the unit a channel-shaped member 152′ is welded to the inner side of the outer trim ring 140 to provide a guide for the outer glass as it is being removed and replaced and also for the purpose of retaining the outer trim ring during the time that the outer glass is removed. The guides also camouflage the edges of the front glass 10 to improve the appearance of the unit. It should also be noted that the flanges 151 of the connector plates 128 are provided with inwardly directed flanges 153 which bear against the inner door panel 30 as shown in FIG. 8. The flanges 153 in effect provide pivot points for the connector plates as the screws 154 are being tightened to provide resilient pressure on the outer glass to prevent rattling.

Figure 11:
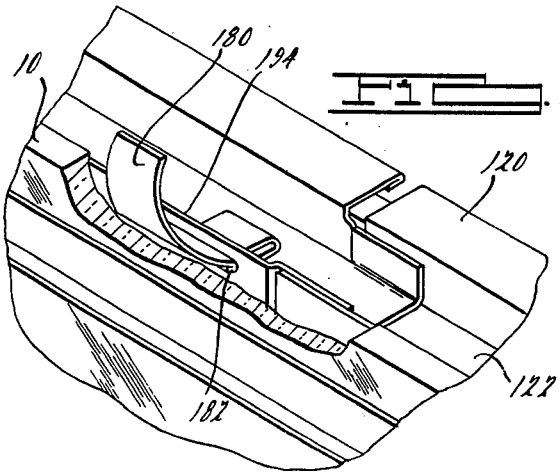
FIG. 11 is a fragmentary perspective view of the window unit shown in FIG. 10.
Figure 10:
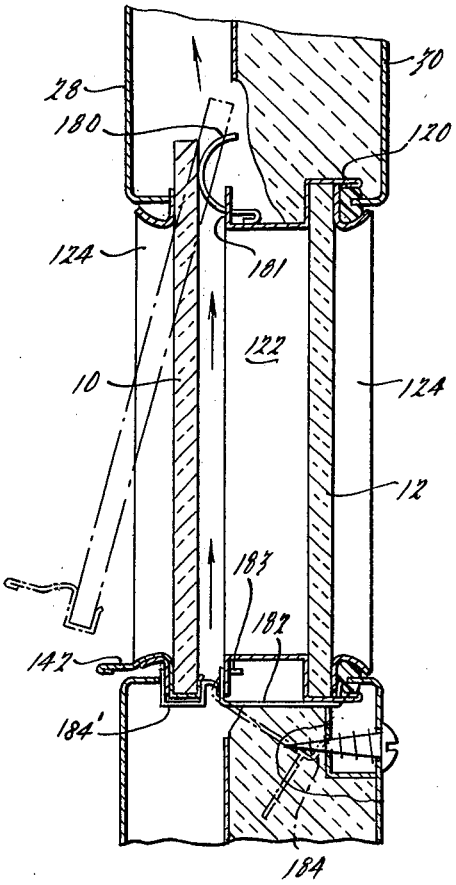
FIG. 10 is a vertical sectional view showing another embodiment of the invention installed in an oven door.

FIGS. 10 and 11 illustrate a modified form of the invention shown in FIGS. 7 and 8. In this form of the invention a leaf spring 180 has its inner end inserted through a slot 181 in the spacer member 122. The connector elements 182 in this form of the invention are essentially the same as the connector elements 128 of FIGS. 7 and 8 except that instead of being welded to the member 122 they are merely snapped into place in the manner illustrated in FIG. 10. For this purpose the connector plates 182 have projections 183 which are inserted into slots in the member 122 and inwardly extending flanges 184 which are adapted to snap into place behind the rear trim ring 124 after which the front glass and its trim ring 124 are inserted into the supporting channels 184′ defined by the connector plates 182. The construction is otherwise the same as disclosed in FIGS. 7 and 8.

Figure 12:
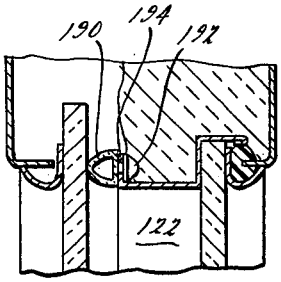
FIG. 12 is a fragmentary vertical sectional view of a modification of the invention shown in either FIG. 7 or FIG. 10.

FIG. 12 illustrates a modified form of the construction shown in FIGS. 7 and 8 or 10 and 11 in which the leaf spring is replaced by a silicone rubber bumper 190 which has its inner end 192 inserted through a slot in the outwardly extending leg 194 of the spacer member 122 and engages the inner surface of the outer glass 10 to firmly seat the glass within its supporting channel.

FIGS. 13–16 illustrate a modified form of the invention in which the front glass panel 10 may be removed in a manner similar to that shown in FIGS. 7 and 10. The connector elements 200 in this form of the invention are very similar in construction to the connector plates shown in FIG. 10 and include projections 183 which are inserted into slots in the wall 185 of the member 122 and inwardly extending flanges 184 which are adapted to snap into place behind the rear trim ring 124, as in the previous modification. The connector plates 200 also have tabs 186 which retain the trim ring 124 and glass 12 against the projections 184. Ribs 190 define one side wall of a channel 192 in which the lower edge of the glass 10 and the lifting tab 142 is seated. Guide channels 202 at the opposite sides of the unit are secured to the spacer member 122 by means of the projections 183 on the mounting clips 200. As in prior modifications, the outer glass 10 is narrower in width than the inner glass 12 so as to permit removal of the glass 10 in the manner illustrated.

Figure 19:
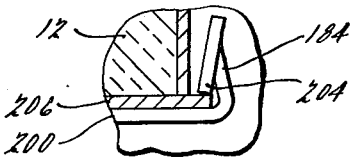
FIG. 19 is a fragmentary sectional view of a portion of the mounting clip emloyed in the units of FIGS. 13 and 17.

The flanges 184 on the mounting clips 200 have a locking tab 204 which is bent inwardly out of the plane of the body of the flanges 184, as more clearly illustrated in FIG. 19. The locking tab 204 engages the flange 206 on the spacer member 122 to prevent the mounting clip from becoming accidentally dislodged from the window unit, particularly during assembly and shipping of the unit. It is to be noted that when the unit is assembled the flanges 184 and 186 tend to resiliently urge the inner glass 12 and its trim ring 124 inwardly toward the inner oven door panel, thereby urging the sealing element 126 against the inwardly turned flange which defines the window opening in the inner door panel. In order to retain the front glass 10 and its trim ring in properly assembled condition during handling, the front trim ring 208 is crimped at its opposite ends, as shown at 210, immediately below the mounting clips at the sides of the unit.

Figure 17:
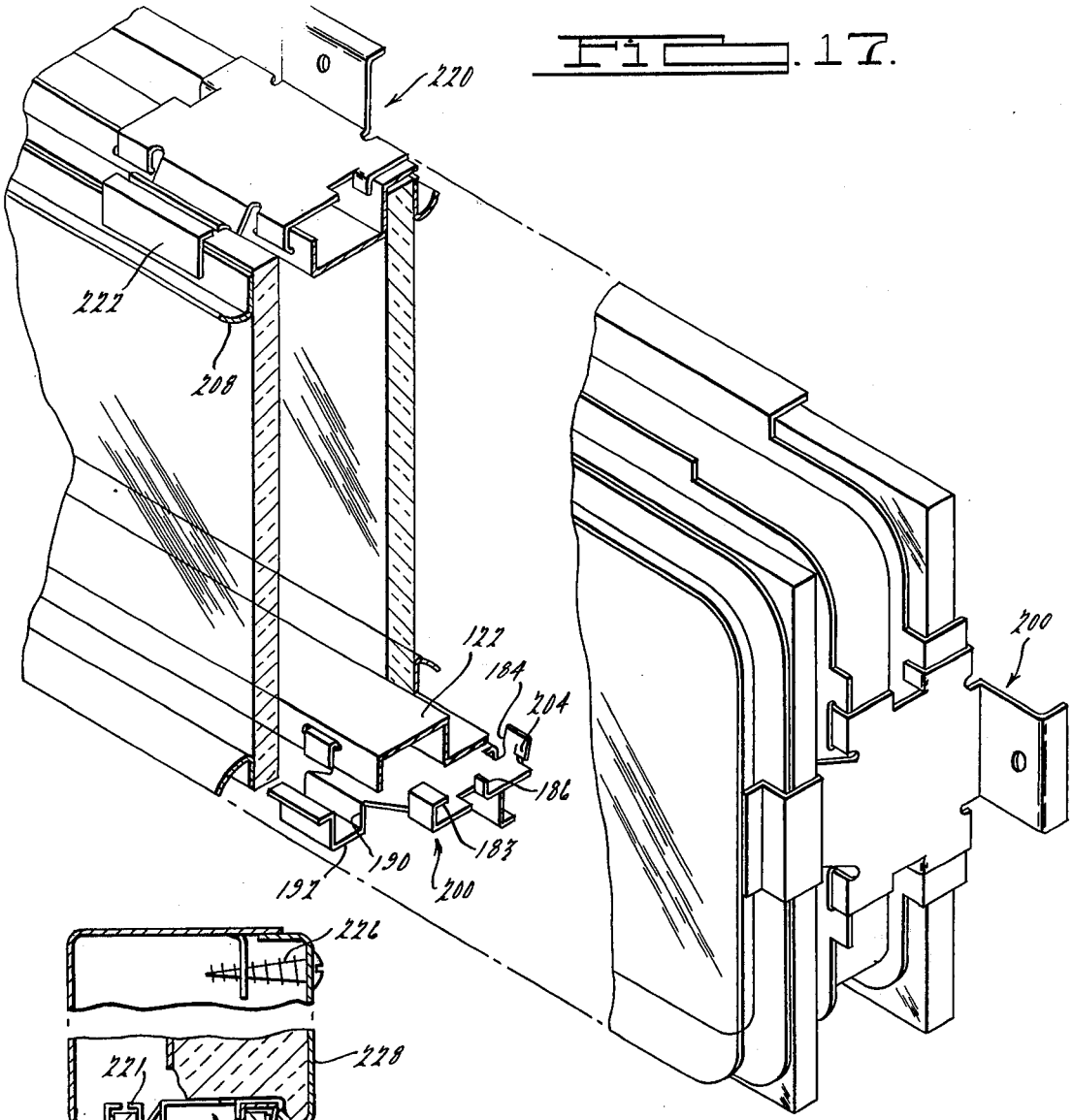
FIG. 17 is a perspective view of a further embodiment of the invention.
Figure 18:
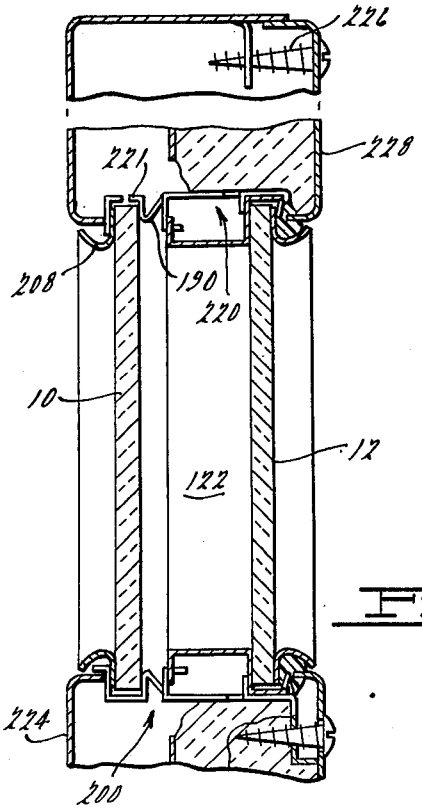
FIG. 18 is a vertical sectional view of the window unit shown in FIG. 17.

In the form of the invention shown in FIGS. 17, 18 and 19, mounting clips 200 identical in construction to those shown in the FIG. 13 modification are employed at the opposite sides and the bottom edge of the window unit. An additional mounting clip 220 is employed at the top edge of the unit. The mounting clip 220 is identical to the clips 200 except that it is cut off just outwardly of the rib 190 so as to include a short outwardly extending wall 221 which overlies the upper edge of the front glass 10. Additionally, an angular strap 222 is welded or otherwise secured to the opposite ends of the front trim ring 208 and prevents movement of the front glass 10 upwardly during shipping and handling. In this form of the invention the front glass 10 is not provided with a lifting tab as in prior modifications. The front glass 10 may be removed for cleaning by first removing the front oven door panel 224 by removing the screws 226 which secure the front and back door panels 224 and 228 together. The glass 10 and its trim ring 208 may then be easily removed by sliding them upwardly past the outwardly extending edge 221 of the mounting clip 220. As shown in FIG. 19, the mounting clips 200 as well as the mounting clip 220 have locking tabs 204 formed on the flanges 184 which snap into place against the spacer member 122 to retain the mounting clips against accidental displacement. These locking tabs 204 of course prevent shifting or unwanted movement of the assembled glass and spacer member during handling and shipping. In this construction, as in prior modifications, the air passage for the flow of cooling air upwardly between the glass panes extends along the entire length of the unit, thus maximizing the air flow while reducing thermal conductivity between the inner and outer sides of the unit to a minimum.

What I claim as my invention is:

1. A self-contained window unit adapted to be assembled into an oven door having front and back door panels with aligned window openings therein and means defining an air passage to allow air to flow upwardly through the door and the window unit therein, comprising first and second opposed glass panes, a continuous spacer member between said panes engaging the peripheral edges of said first pane and being spaced from the said second pane to define openings at the top and bottom of said unit communicating with the air passage in the door, connector plates extending across the peripheral edges of said panes at the bottom and side edges of said window unit, the connector plate at the bottom edge of said window unit including a channel formation surrounding the peripheral edge of one of said panes, said connector plates having flange portions holding said spacer member against the other said pane and holding said panes in spaced parallel relation, said one pane being removable from said channel formation by upward sliding movement to permit removal of said one pane.

2. A self-contained window unit adapted to be assembled into an oven door having front and back door panels with aligned window openings therein and means defining an air passage to allow air to flow upwardly through the door and the window unit therein, comprising a pair of glass panes, a continuous spacer member between said panes engaging the peripheral edges of one of said panes and being spaced from the other of said panes to define openings at the top and bottom of said unit communicating with the air passage in the door, a continuous trim ring for each pane engaging the exposed surface thereof at its peripheral edges, connector plates extending across the peripheral edges of said panes at the bottom and side edges of said window unit, the connector plate at the bottom edge of said window unit including a channel formation surrounding the peripheral edge of said other of said panes and clamping a trim ring against said other pane, said connector plates having flange portions holding said spacer member and the other trim ring against said one pane and holding said panes in spaced parallel relation, said other pane being removable from said channel formation by upward sliding movement to permit removal of said other pane.

3. A window unit according to claim 2 wherein said connector plates are provided with a locking tab engaging said spacer member to lock said connector plates to said spacer member.

4. A window unit according to claim 2 wherein said connector plates have means thereon engageable with said spacer member for detachably securing said plates thereto to retain the window unit in assembled condition.

5. A window unit according to claim 4 including a connector plate at the top edge of said window unit and having a retaining flange extending only partially across the top edge of said other pane to releasably hold said other pane against said upward sliding movement.

6.A window unit according to claim 2 including a lifting tab surrounding the bottom edge of said other pane for lifting said other pane out of said channel formation.

7. A window unit according to claim 6 wherein said other pane has a width narrower than its trim ring to permit tilting of said other pane outwardly through its trim ring for removal of said other pane.

8. A window unit according to claim 7 including guide channels secured to said spacer member at the vertical sides of said unit for confining said other pane against lateral movement and forming a part of the air flow passage through said unit.

9. A window unit according to claim 3, wherein a lifting tab is provided on the lower edge of said other pane.

10. A self-contained window unit adapted to be assembled into an oven door having front and back door panels with aligned window openings therein and means defining an air passage to allow air to flow upwardly through the door and the window unit therein, comprising a pair of glass panes, means holding said panes in spaced, opposed, parallel relation, said holding means having areas thereof between said panes at the top and bottom of the window unit defining openings communicating with the air passage in the door to allow the air to flow over the inner surface of the outer glass pane, said holding means including provisions for releasably securing at least one of said panes in said relation whereby said one pane may be removed from said holding means to allow cleaning of the inner surfaces of both said panes, said holding means comprising a plurality of individual, peripherally spaced connector plates extending between and holding said panes in spaced parallel relation, said connector plates being provided on the opposite sides and bottom of said unit.

11. A window unit according to claim 10, including a continuous spacer member between said panes engaging the peripheral edge of either one of said panes but being spaced from the other of said panes at least at its top and bottom edges to define said air passage openings.

12. A self-contained window unit adapted to be assembled into an oven door having front and back door panels with aligned window openings therein and means defining an air passage to allow air to flow upwardly through the door and the window unit therein, comprising first and second opposed glass panes, a continuous member engaging the peripheral edges of said first pane and being spaced from said second pane at the top and bottom of said unit to define openings communicating with the air passage in the door, connector plates extending across the peripheral edges of said panes at the bottom and side edges of said window unit, the connector plate at the bottom edge of said window unit including a channel formation surrounding the peripheral edge of one of said panes, said connector plates having flange portions holding said continuous member against the other of said panes and holding said panes in spaced parallel relation, said one pane being removable from said channel formation by upward sliding movement to permit removal of said one pane.

* * * * *